US005503054A

United States Patent [19]

Ellsworth et al.

[11] Patent Number: 5,503,054

[45] Date of Patent: Apr. 2, 1996

[54] MUSICAL INSTRUMENT BRIDGE

[75] Inventors: Lynn K. Ellsworth, Federal Way; John D. Shaneyfelt, Auburn, both of Wash.

[73] Assignee: 2TEK Corporation, Kent, Wash.

[21] Appl. No.: 236,388

[22] Filed: Apr. 29, 1994

Related U.S. Application Data

[63] Continuation-in-part of Ser. No. 68,541, May 27, 1993, Pat. No. 5,410,936.

[51] Int. Cl.[6] ..... G10D 3/04; G10D 1/08

[52] U.S. Cl. ..... 84/307; 84/298; 84/267

[58] Field of Search ..... 84/297 R, 298, 84/299, 307, 308, 309, 267, 268, 269, 274, 312 R, 313, 294, 312 P

[56] References Cited

U.S. PATENT DOCUMENTS

| | | | |
|---|---|---|---|
| 608,279 | 8/1898 | Benson . | |
| 870,283 | 11/1907 | Green . | |
| 1,259,062 | 3/1918 | Wilber . | |
| 2,343,384 | 3/1944 | McDonald | 84/309 |
| 2,625,849 | 1/1953 | Melita | 84/309 |
| 2,828,660 | 4/1958 | Paulsen | 84/312 |
| 2,846,915 | 8/1958 | Daria | 84/307 |
| 3,251,257 | 5/1966 | Bunker | 84/267 |
| 3,353,433 | 11/1967 | Webster | 84/294 |
| 3,439,571 | 4/1969 | Ryan | 84/312 |
| 4,201,108 | 5/1980 | Bunker | 84/1.16 |
| 4,253,371 | 3/1981 | Guice | 84/267 |
| 4,742,750 | 5/1988 | Storey | 84/313 |
| 5,018,423 | 5/1991 | Bunker et al. | 84/293 |
| 5,198,601 | 3/1993 | McCabe | 84/298 |

FOREIGN PATENT DOCUMENTS 2616257 12/1988 France .

OTHER PUBLICATIONS

PBC Guitar Technology advertisement, 2 pp., (date: unknown but believed to be before May, 27, 1992).

*Primary Examiner*—Cassandra Spyrou

*Attorney, Agent, or Firm*—Christensen, O'Connor, Johnson & Kindness

[57] ABSTRACT

A musical instrument bridge (50) is supporting a set of strings (22) above a front face (14) of a musical instrument (12). The bridge has a plate (60), a mounting block (80), and a plurality of fingers (100). The plate is attachable to a rear face of the instrument. The plurality of fingers are cantilevered from the plate and extend outwardly therefrom. Each finger has a resonant frequency or rigidity that is related to a predetermined pitch of the string supported by the finger. Each finger is designed to vibrate in a plane that is parallel to the front face of the instrument but to reduce vibration in a plane perpendicular to the front face of the instrument.

50 Claims, 12 Drawing Sheets

MUSICAL INSTRUMENT BRIDGE

RELATED APPLICATIONS

The present application is a continuation-in-part of our U.S. patent application Ser. No. 08/068,541 filed May 27, 1993, now U.S. Pat. No. 5,410,936 titled Musical Instrument Bridge, which is expressly incorporated by reference herein.

FIELD OF THE INVENTION

The present invention relates to musical instruments in general, and in particular to musical instrument bridges.

BACKGROUND OF THE INVENTION

In recent years, significant improvements have been made in the quality of musical instruments, particularly electric instruments such as electric guitars and electric bass guitars. However, the majority of the improvements that have occurred in such instruments are due to improvements made in the electronic components used with such instruments. These electronic components include pickups, amplifiers and special effects. One component of a musical instrument that has remained virtually unchanged since the first electric instruments were introduced is the instrument bridge.

A bridge on a musical instrument is designed to support a set of strings at a predetermined distance above the instrument's fretboard. It has been discovered that prior art bridges are the source of, or at least contribute to, three errors in the production of sound from an instrument. The first error is interstring modulation, whereby striking one string causes another string on the instrument to vibrate. If the pitch of the vibrating strings are not harmonically related, such interstring modulation can produce unclear, distorted sounds. The second problem associated with traditional instrument bridges is the fact that they dampen a string's vibration once it is played. This is particularly true of tremolo-type bridges that are coupled to the body of a musical instrument via one or more springs. These springs dissipate a portion of the energy of a plucked string, thereby reducing the sustain of a note played. The third problem contributed by prior art bridge designs is the signal distortion that occurs after the string is struck. When a string is initially struck, the string moves back and forth in a plane that is substantially parallel to the front face of a musical instrument and perpendicular to a magnetic field produced by an instrument pickup. This parallel movement produces the cleanest sound with the fewest undertones and overtones. However, shortly after the string is struck, the plane in which the string is vibrating begins to rotate in an elliptical fashion. As the plane of the string vibration changes, the signal produced by the pickup begins to sound slightly distorted.

In order to solve the problems associated with prior art bridge designs, there is a need for a musical instrument bridge that reduces interstring modulation, does not excessively dampen a string's vibration and confines a string's vibration to a single plane that is substantially perpendicular to the direction of a magnetic field produced by a pickup.

SUMMARY OF THE INVENTION

The present invention is a musical instrument bridge that supports a set of strings at a predetermined distance above a front face of a musical instrument. Each string supported by the bridge is tuned to a predetermined pitch when the musical instrument is played. The bridge includes a plate that is secured to a rear face of a musical instrument and a plurality of fingers that are secured to the plate and extend toward a front face of the musical instrument. Each of the fingers includes a head portion that supports a string at the predetermined distance above the front face of the musical instrument, a base portion at which the finger is secured to the plate and a waist portion that extends between the base portion and the head portion. Each finger has a resonant frequency that is related to the predetermined pitch of the string supported by the finger.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
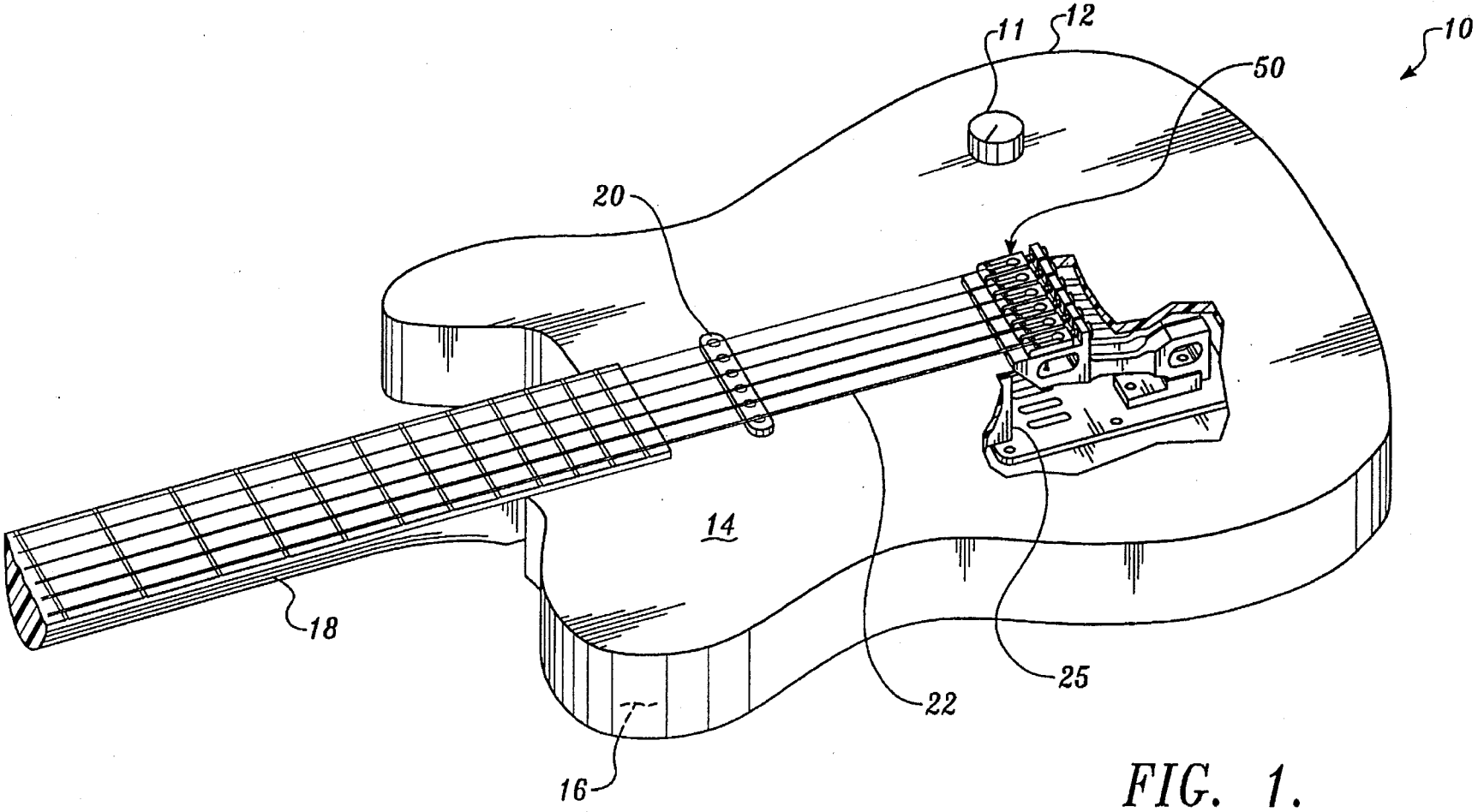
FIG. 1 is a fragmentary isometric of an electric guitar with pans broken away for illustration of the musical instrument bridge according to the present invention.

FIG. 1 illustrates a musical instrument, namely, an electric guitar 10, having a bridge 50 according to the present invention. Other than the bridge, the electric guitar is conventional, including a body 12 having a front face 14 and a rear face 16, as well as a volume control 11, a fretboard 18, an electrical pickup 20 and a set of strings 22.

The bridge 50 is secured to the rear face 16 of the instrument and lies mostly within a recessed area 25 of the instrument body 12, in the same fashion as existing tremolo-type bridges are mounted in electric guitars. In fact, replacing the conventional bridge of an electric guitar with a bridge according to the present invention does not require any major modifications to the guitar other than perhaps reshaping the recessed area 25 of the instrument body. The bridge 50 maintains the strings 22 at a predetermined position over the fretboard 18 and the pickup 20. As will be described in greater detail below, the bridge 50 according to the present invention improves isolation between the strings thereby reducing interstring modulation, increases the harmonic content and sustain of the strings, and reduces distortion due to the orbital motion of a vibrating string.

Figure 2:
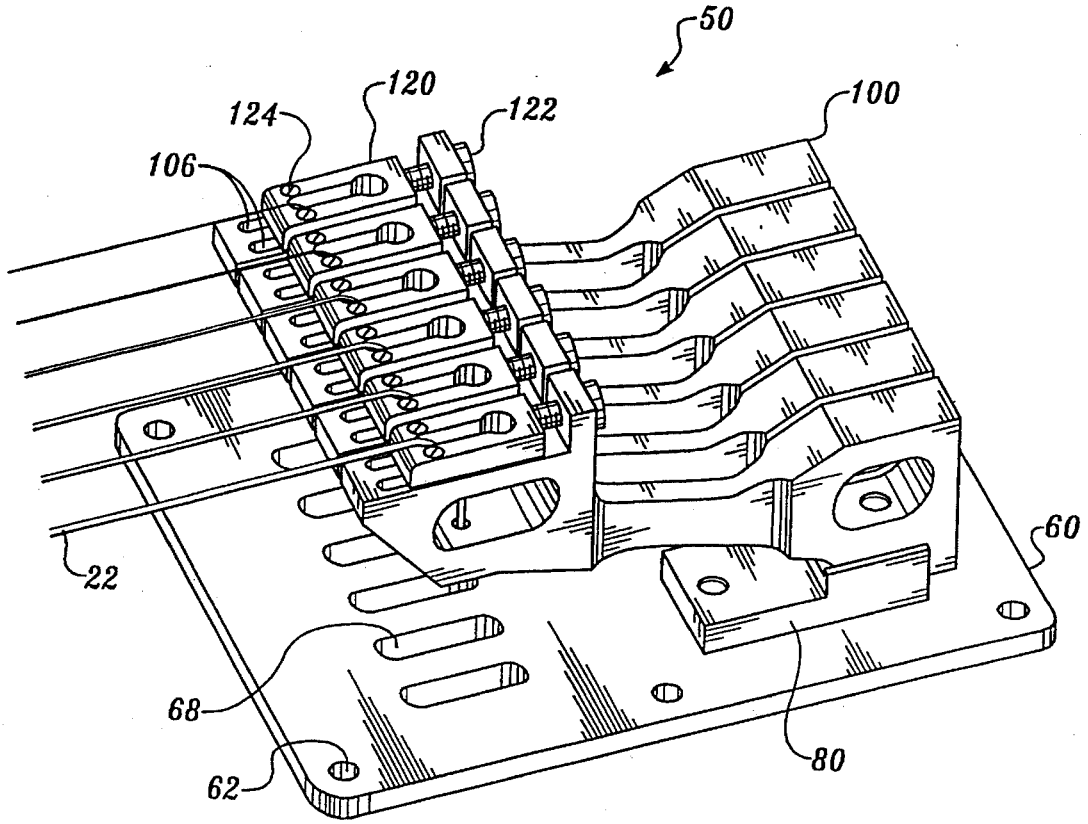
FIG. 2 is an isometric of the musical instrument bridge according to the present invention.

As shown in FIG. 2, the bridge 50 according to the present invention includes a plate 60, a mounting block 80 and a plurality of fingers 100. Disposed on top of each of the fingers 100 is a conventional saddle 120 that determines the height of a string 22 above the fretboard. Each saddle 120 includes a longitudinal adjustment screw 122 for moving the body of the saddle closer to or farther away from the fretboard, as well as a pair of vertical adjustment screws 124 to vary the height of the string 22 above the fretboard. The details of the saddle 120 are conventional and are well known to those of ordinary skill in the musical instrument arts.

As will be described in further detail below, each of the fingers 100 has a resonant frequency that is related to the pitch of the string 22 that is supported by the finger. The resonant frequency of each finger is selected assuming each string will be tuned to a standard predefined pitch. However, if it is desired to tune the instrument to something other than the standard tuning, it may be necessary to replace one or more fingers of the bridge with fingers that are designed for the alternate pitch. Additionally, because "most appropriate" resonant frequency for each finger is somewhat a matter of taste, it is possible that a finger having a fixed resonant frequency may sound acceptable for more than one tuning of the guitar. For the purposes of this specification, the terms "pitch" and "resonant frequency" are synonymous, with each term being used where appropriate for clarity.

Figure 3:
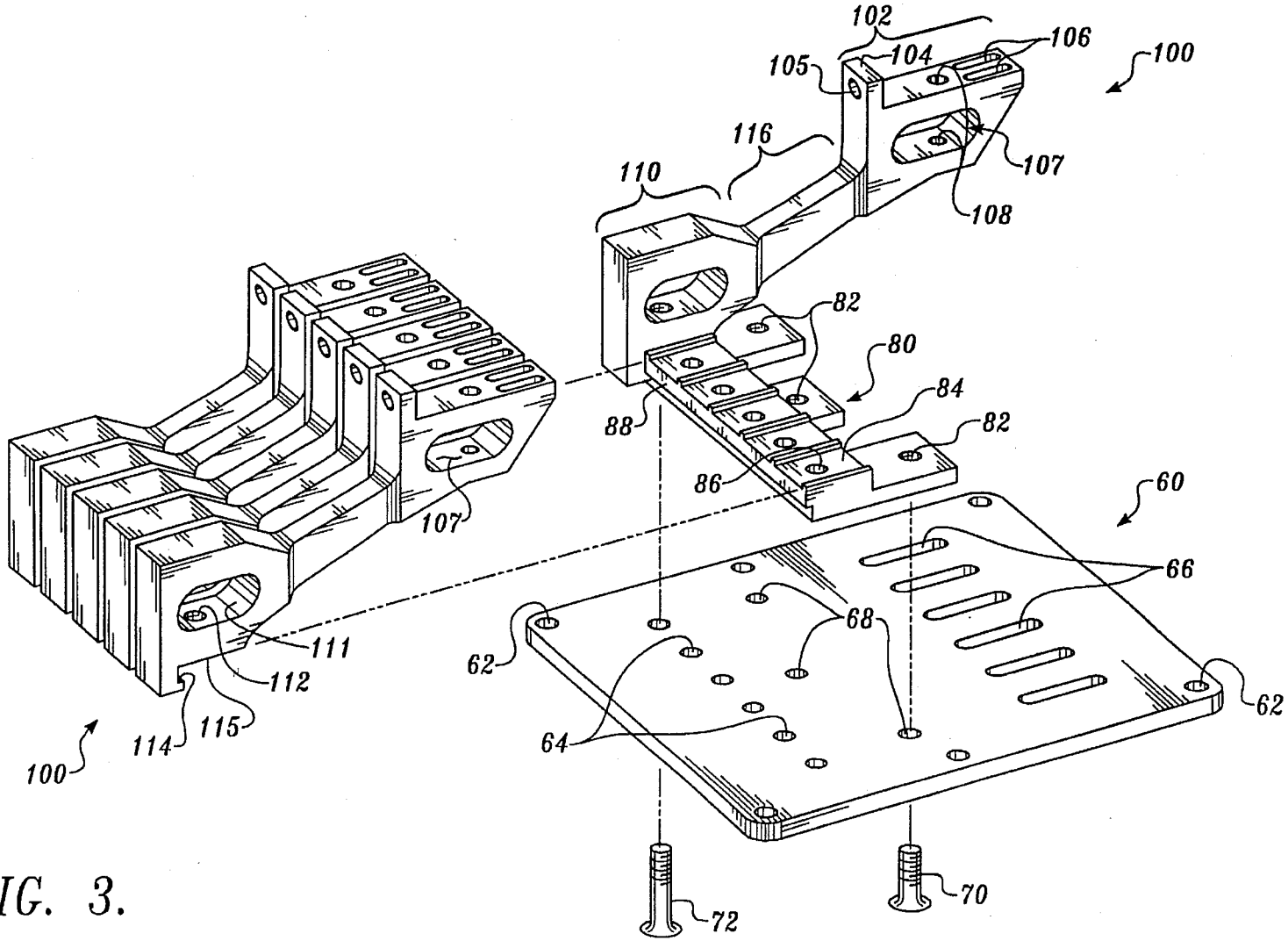
FIG. 3 is an isometric of a musical instrument bridge according to the present invention, with pans shown in exploded relationship.

With reference to FIG. 3, the plate 60 includes a plurality of holes 62 disposed around the perimeter of the plate through which screws or other suitable fastening means may be inserted to secure the plate to the rear face of the musical instrument. The plate 60 also includes a plurality of slots 66 through which a string may be threaded without removing the plate or other bridge components from the instrument. Finally, the plate 60 includes a plurality of holes 68 which are aligned with a set of corresponding threaded holes 82 on the mounting block 80 for machine screws 70 or other suitable fasteners to secure the mounting block 80 to the plate 60.

The mounting block 80 also includes a series of unthreaded holes 86 through which a number of machine screws 72 or other suitable fasteners are passed. The machine screws 72 engage a threaded portion of the fingers 100 as will be described. The mounting block 80 includes a plurality of slots 84 in which the base portions of the fingers 100 are fitted. Finally, the mounting block 80 includes an outwardly extending lip 88 that mates with a corresponding groove 114 on each of the fingers 100.

The shape of the mounting block 80 is determined by the type of instrument in which the bridge in accordance with the present invention is to be used. It may be necessary to make the mounting block taller or shorter to position the fingers so that the strings are at the correct height above the fret board of the instrument. Additionally, some portions of the mounting block may be removed to reduce the mass of the mounting block.

Each finger 100 has three portions, a head portion 102, a base portion 110 and a waist portion 116 that connects the base portion to the head portion. The head portion 102 includes a saddle stop 104 having an unthreaded hole 105 for the longitudinal adjustment screw that secures the saddle on top of the head portion of the finger. Also disposed on the head portion 102 are a set of grooves 106 that receive the vertical adjustment screws 124 of the saddle as shown in FIG. 2. The grooves 106 maintain the alignment of the saddle on the head portion of the finger. Returning to FIG. 3, the head portion 102 includes an unthreaded hole 108 through which a musical instrument string is passed. A section 107 of the head portion 102 may be hollowed to reduce the mass of the head portion in order to adjust the resonant frequency of the finger as will be described below.

The base portion 110 of each finger 100 includes a threaded hole 112 that receives the machine screw 72 to secure the finger to the mounting block 80 and the plate 60. The base portion also includes a groove 114 that snugly receives the outwardly extending lip 88 of the mounting block for a secure interconnection that assures that the finger will not rotate forward when the strings supported by the bridge are tightened. Adjacent the groove 114 is a flat portion 115 that contiguously engages the slot 84 when the finger is secured to the mounting block. When the machine screw engages the threaded hole 112, the finger is cantilevered from the mounting block. A space between each slot 84 ensures that the fingers of the bridge are isolated from one another except for their common connection to the mounting block. Finally, the base portion of the finger includes a hollowed section 111 which reduces the mass of the base portion.

The waist portion 116 of the finger extends between the base portion 110 and the head portion 102. The waist portion has a width dimension that is parallel to the plane of the plate 60 and a height dimension that is perpendicular to the plane of the plate 60. In the present embodiment of the invention, the width dimension is smaller than the height dimension to allow the finger to vibrate in a plane parallel to the plane of the plate 60, but to substantially reduce vibration of the finger in a plane perpendicular to the plate 60. Although not clearly shown in FIG. 3, the waist portions of the fingers have varying widths that are selected for each string of the guitar supported by the finger. Waists of different widths result in different fingers having different flex and vibrational characteristics.

Figure 4:
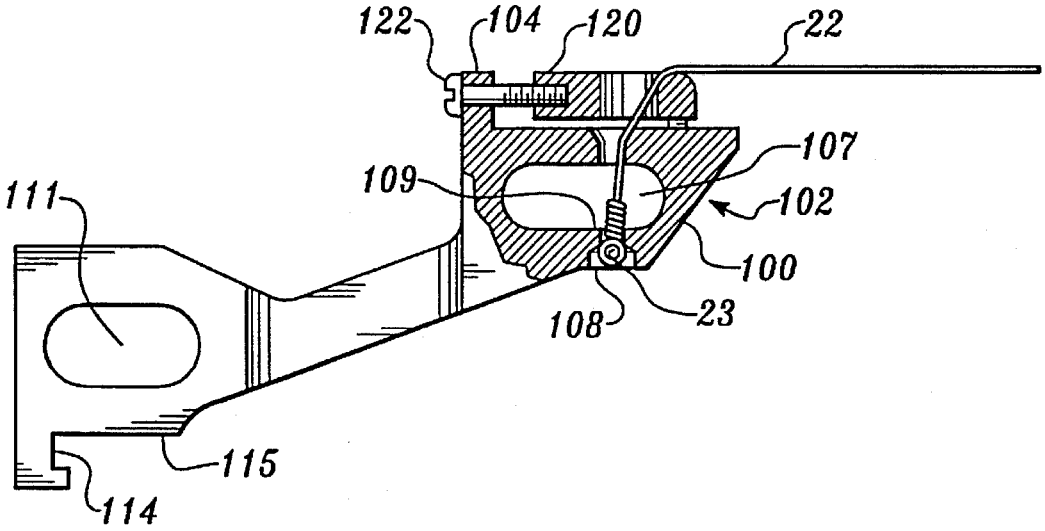
FIG. 4 is a side elevation of the musical instrument bridge finger according to the present invention, with pans broken away.

As best seen in FIG. 4, the head portion 102 includes the saddle stop 104 providing an abutment for the longitudinal adjustment screw 122 which secures the saddle 120 to the finger. To anchor an end of the string 22 to the finger 100, a ball 23 at the end of the string 22 engages against a shoulder 109 encircling the hole 108.

Figure 5:
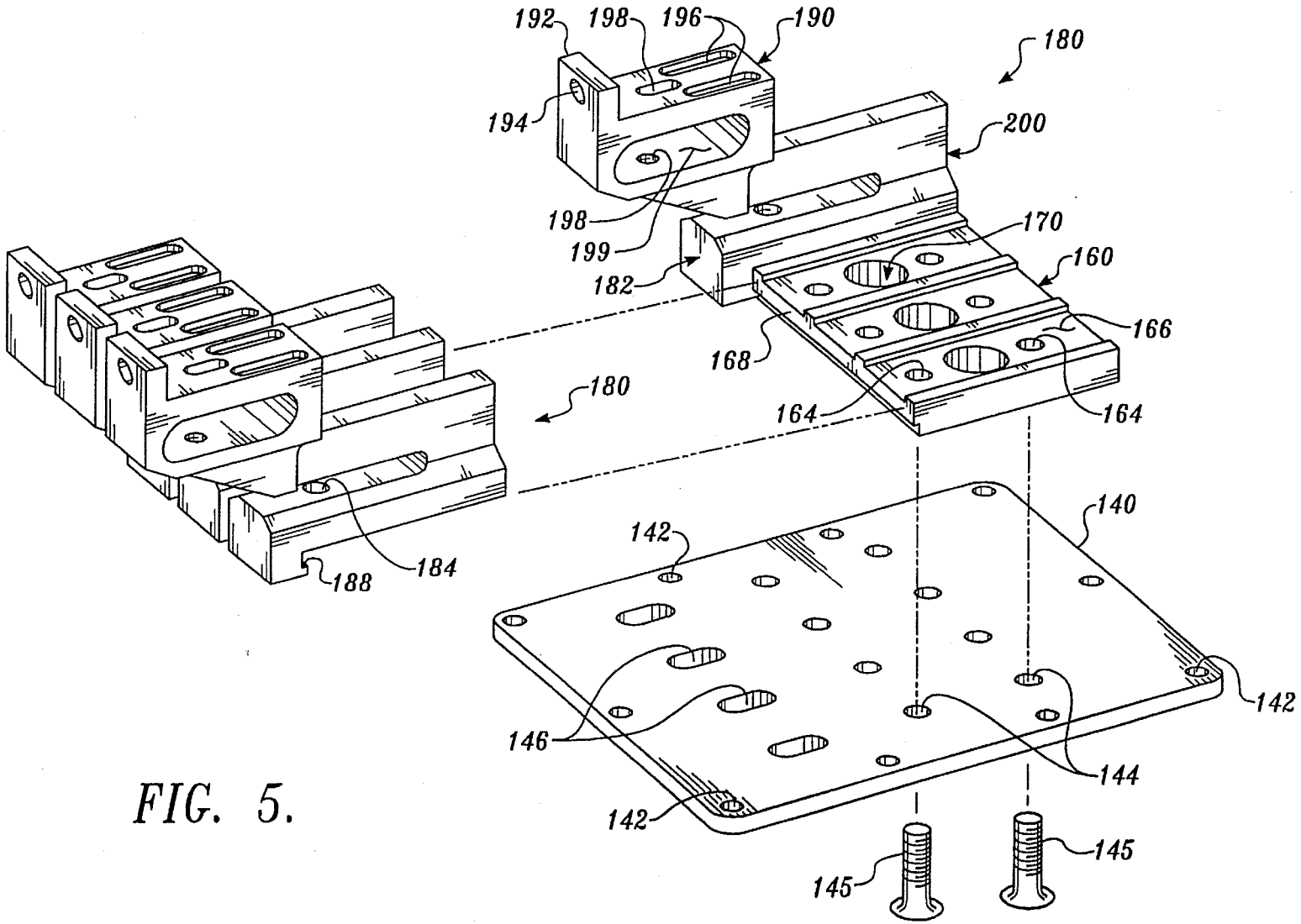
FIG. 5 is an isometric of a musical instrument bridge for a bass guitar according to the present invention.

FIG. 5 shows a second embodiment of a musical instrument bridge according to the present invention, designed for use in an electric bass guitar, typically having four strings (not shown). In contrast with the first embodiment described above, the second embodiment of the present invention is designed to withstand the extra stresses produced by the bass guitar strings. The instrument bridge includes a plate 140 having a plurality of holes 142 disposed around the perimeter. The holes 142 receive screws or other suitable fastening means for securing the bridge to a rear face of a bass guitar (not shown). Also included in the plate 140 are a plurality of holes 144 through which a plurality of machine screws 145 or other suitable fasteners are passed to secure a mounting block 160 to the plate 140. Finally, the plate 140 includes a series of slots 146 through which the bass guitar strings may be threaded.

The mounting block 160 includes a plurality of holes 164 through which the machine screws 145 are passed for reception of their threaded ends in threaded mounting holes 184 of bridge fingers 180. The mounting block 160 also includes a plurality of slots 166 in which the fingers 180 are snugly fitted and an outwardly extending lip 168 that mates with a corresponding groove 188 on each finger 180. Again, the slots 166 maintain the separation of the fingers 180 so that the fingers are isolated from one another, thereby decreasing the amount of string intermodulation. The mounting block 160 includes hollowed portions 170 within the slots 166 in order to reduce the weight of the mounting block.

The fingers 180 include base portions 182, head portions 190 and waist portions 200 that extend between the base portions and the head portions. Each base portion includes a pair of threaded holes 184 (only one of which is visible in FIG. 5) that receive the upper threaded ends of the machine screws 145 in order to secure the corresponding finger 180 and mounting block 160 to the plate 140. The groove 188 described above mates with the outwardly extending lip 168 for additional protection against the finger rotating forward when the musical instrument is played.

Figure 6:
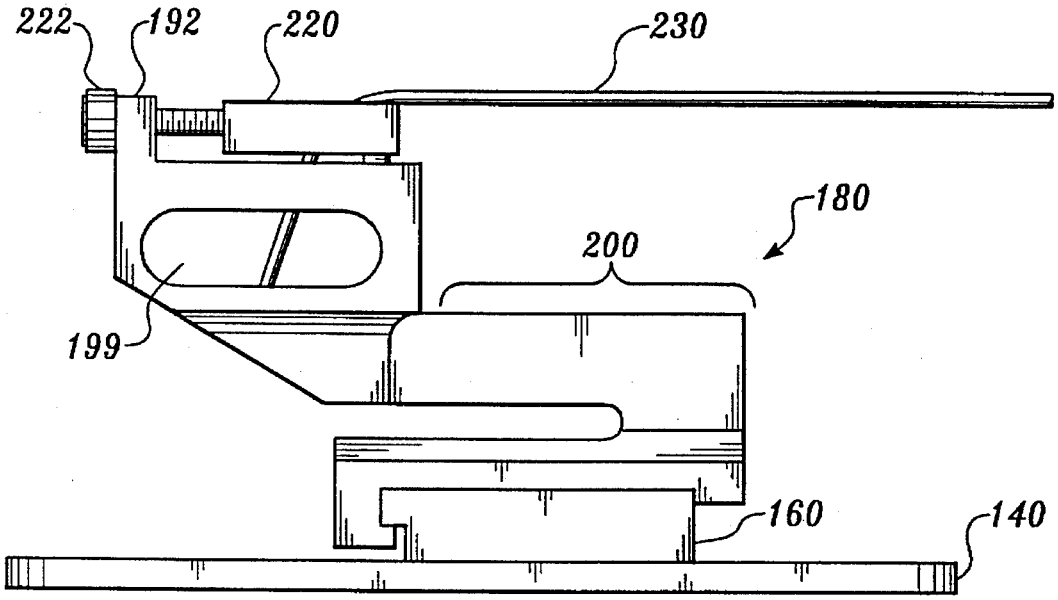
FIG. 6 is a side elevation of the musical instrument bridge shown in FIG. 5.
Figure 6A:
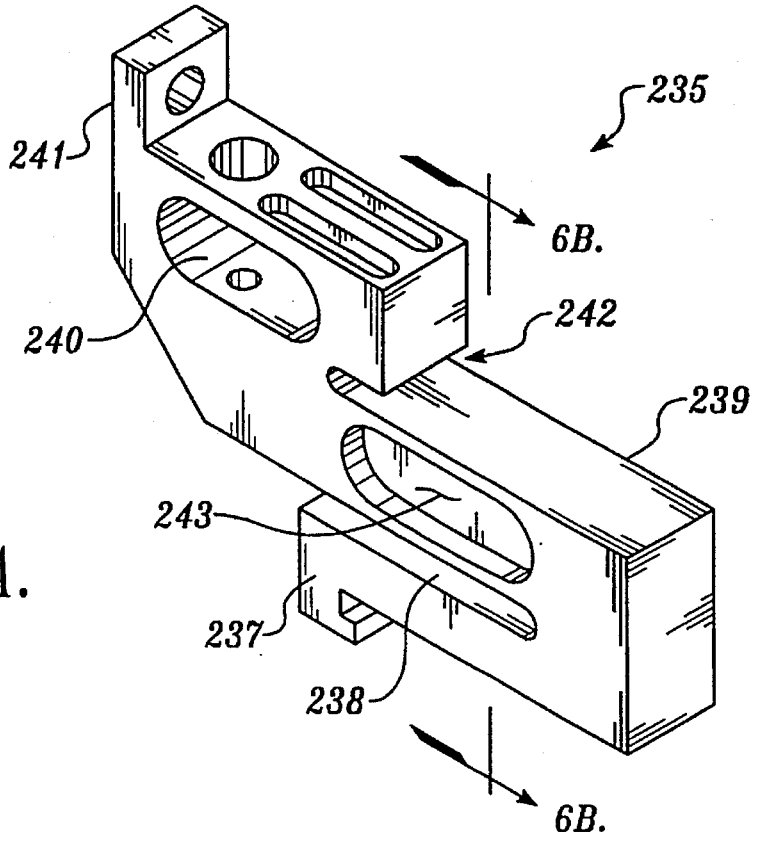
FIG. 6A is an isometric of an alternate embodiment of a finger of the bass guitar bridge according to the present invention.

The head portion 190 of the finger includes a saddle stop 192 having a horizontal hole 194 a screw 222 for securing a saddle 220 to the head portion, as is shown in FIG. 6. The head portion of the finger 180 further includes a pair of slots 196 (FIG. 5) that maintain the alignment of the saddle 220 on the head portion of the finger. The head portion includes a hole 198 through which a string is threaded. An area 199 of the head portion may be hollowed to reduce the weight of the finger, and to adjust the resonant frequency of the finger.

With reference to FIG. 6, a musical string 230 is secured by the head portion of the finger 180 at the proper height above the fretboard of the musical instrument (not shown). The saddle 220 is secured on top of the finger by an adjustment screw 222 that extends through the saddle stop 192.

The finger 180 includes a waist portion 200 that extends between the base portion and the head portion of the finger. The waist portion has a width dimension that extends parallel with the plane of the plate 140 and a height dimension that extends perpendicular to the plane of the plate 140. Preferably, the width dimension is smaller than the height dimension in order to allow the string 230 to vibrate the finger in a plane substantially parallel to the plane of the plate 140 but to reduce vibration in a plane perpendicular to the plate 140. This lateral movement reduces distortion that occurs because of the tendency of the string 230 to vibrate in an elliptical path once it is played.

Each of the fingers 100, 180 has a resonant frequency that is related to the pitch of the strings 22, 230 when the musical instrument is played. The resonant frequency can be adjusted by varying the mass of the finger, the width of the waist portion, the effective length of the waist portion and the materials from which the finger, mounting block and plate are made. It has been determined that brass and stainless steel provide the most appropriate materials from which to make the plate, mounting block, and fingers. These materials have been shown to provide the requisite strength and mass required to give the fingers the appropriate resonant frequency. In the currently preferred embodiment of the musical instrument bridge, brass is used for the fingers and the plate because it is less expensive and easier to machine. However, those skilled in the art will appreciate that other materials, such as titanium, could be used. For the first two embodiments of the present invention described above, the resonant frequency is determined by the thickness of the finger waist portion. Different fingers have different thicknesses to accommodate strings of different pitches. The different waist thicknesses result in different masses, and also affect the rigidity or flexibility of the interconnection between the string-anchoring head portion and the base portion.

In the alternative embodiment shown in FIGS. 6A–6E, a finger 235 includes a base portion 237, a head portion 241, and a waist portion 239 that extends between the base portion and the head portion. The base portion 237 is generally separated from the head portion 241 by a groove 238. The major difference between the finger 235 and the fingers previously described is the way in which the resonant frequency of the finger is modified. Instead of modifying the resonant frequency by varying the width of the waist portion as described above, the resonant frequency of the finger 235 is modified by adding a pair of opposing slots 243 in the waist portion 239, modifying the size of the area 240 removed from the head portion 241 and varying the length of the groove 238. All these changes have the effect of modifying the mass of the finger. In addition, changing the length of groove 238 has the effect of changing the rigidity of the connection of the string-anchoring head portion of the finger to the base portion.

Figure 6B:
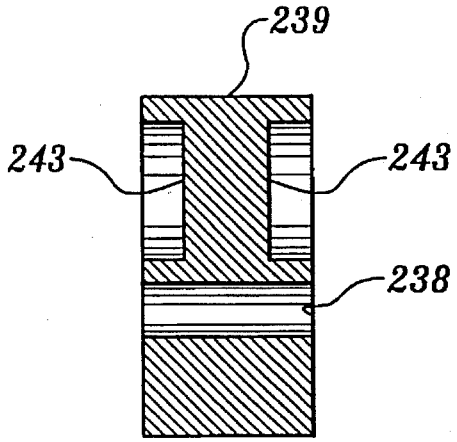
FIG. 6B is a vertical section along line 6B—6B of FIG. 6A.

As can be seen in FIG. 6B, the opposing slots 243 extend inward from both sides of the finger, thereby creating an "I beam" within the waist portion 239 with the web of the beam extending vertically. Since an I beam is strongest in the direction of its web, the opposing slots 243 promote lateral movement of the finger while inhibiting vertical movement, thereby contributing to string sustain and reduced distortion of the bass guitar string supported by the finger.

Figure 6C:
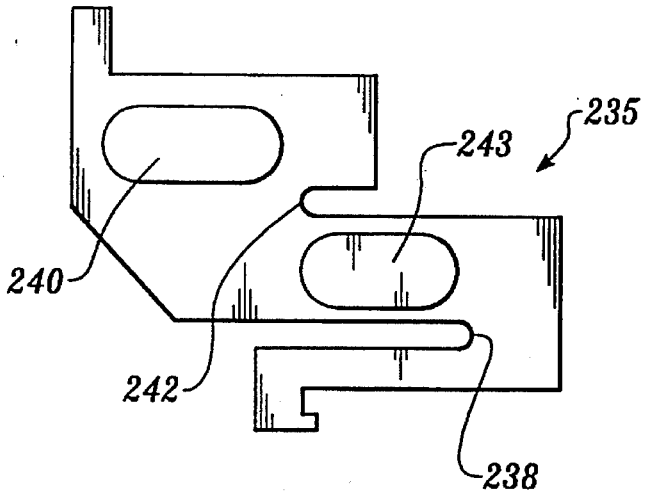
FIGS. 6C, 6D and 6E are corresponding side elevations of three embodiments of the finger shown in FIG. 6A.
Figure 6D:
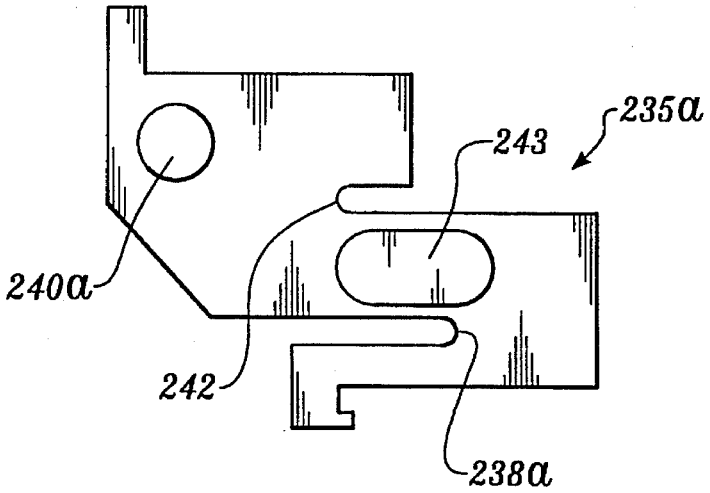

FIGS. 6C–6D are side views of three embodiments of the finger 235 for use in either a four or five string bass guitar. FIG. 6C shows a finger 235 for the A, D, and G strings of a conventionally tuned four or five string bass guitar. The finger 235 includes the groove 238 that divides the base portion of the finger from the waist portion. A generally oval area 240 is removed from the head portion of the finger to reduce the mass of the head portion for affecting the resonant frequency of the finger. In addition, a groove 242 extends from the waist portion into the head portion of the finger which increases the effective length of the waist portion and affects flex characteristics and the resonant frequency, in addition to decreasing the mass of the finger.

FIG. 6D is a side view of a finger **235*a* used for a low E-string of a four or five string bass guitar. The finger 235*a* has a pair of opposing slots 243 that are the same dimension as for the finger 235, but has a groove 238*a* shorter than the groove 238. In addition, the finger 235*a* has a smaller, circular portion 240 removed from the head portion of the finger. The mass of the finger 235*a* is greater than that of the finger 235, and the effective length of the waist portion is greater, thereby giving the finger 235*a*** a lower resonant frequency.

Figure 6E:
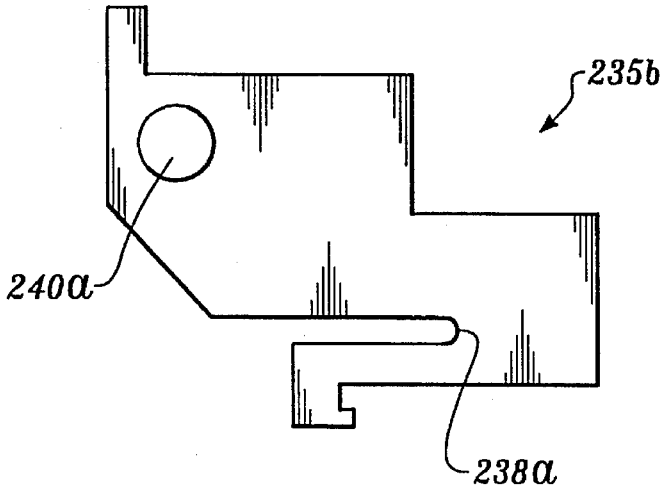

FIG. 6E is a side view of a finger **235*b* for use on a low B string on a five string bass guitar. The finger 235*b* lacks the slots 243 and the groove 242 of fingers 235 and 235***a*. The area 240*a* removed from the head portion is the same size as is found in the finger 235*a*. Finally, the groove 238*a* is the same as that found in the finger 235*a*, but, nevertheless, the effective length of the waist portion is shorter because there is no upper slot below the head portion. The finger 235*b* is heavier than finger 235 and 235*a*, and the finger 235*b* has the lowest resonant frequency.

Figure 7A:
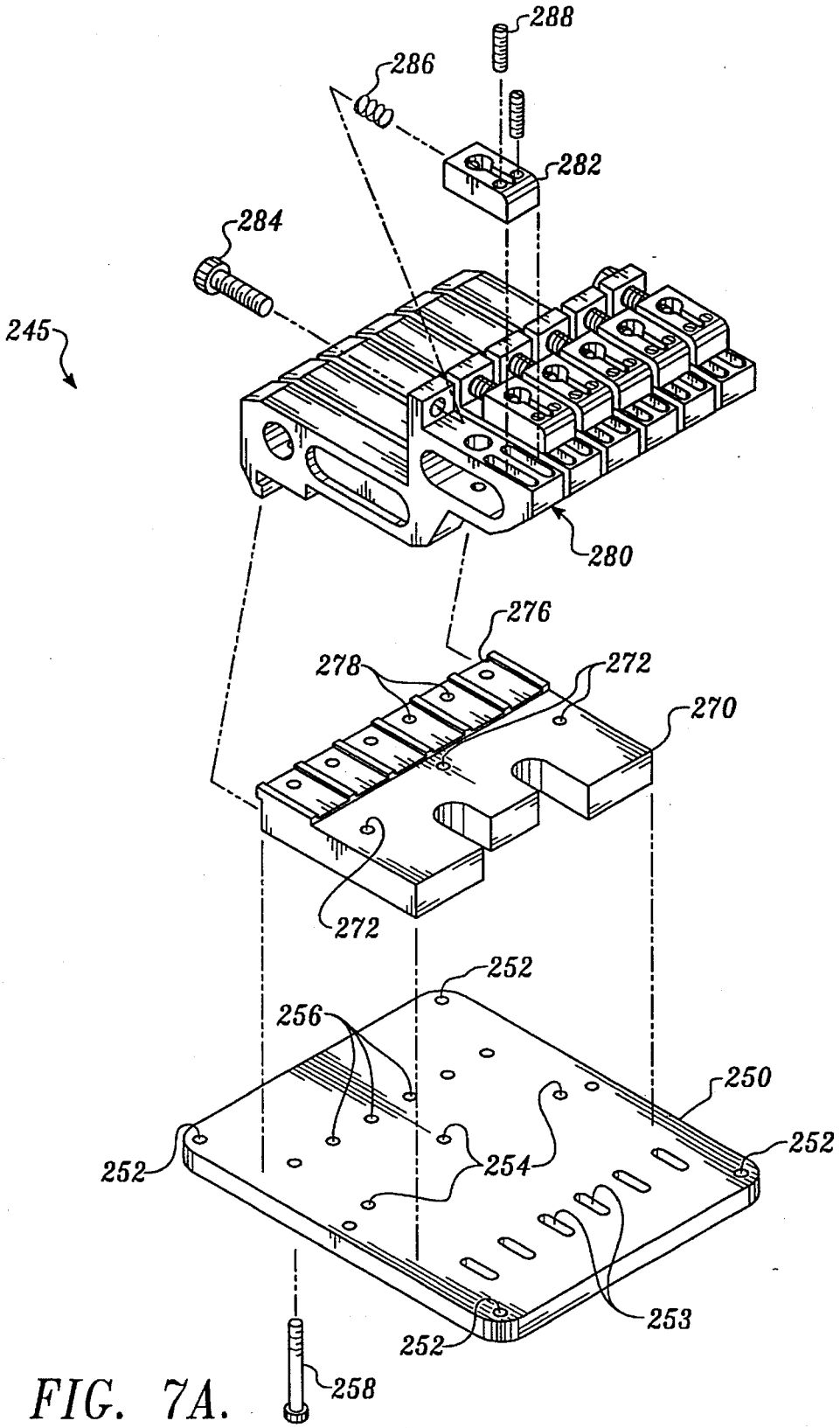
FIG. 7A is an isometric of an alternate embodiment of the musical instrument bridge for a six-string guitar according to the present invention, with parts shown in exploded relationship.
Figure 7B:
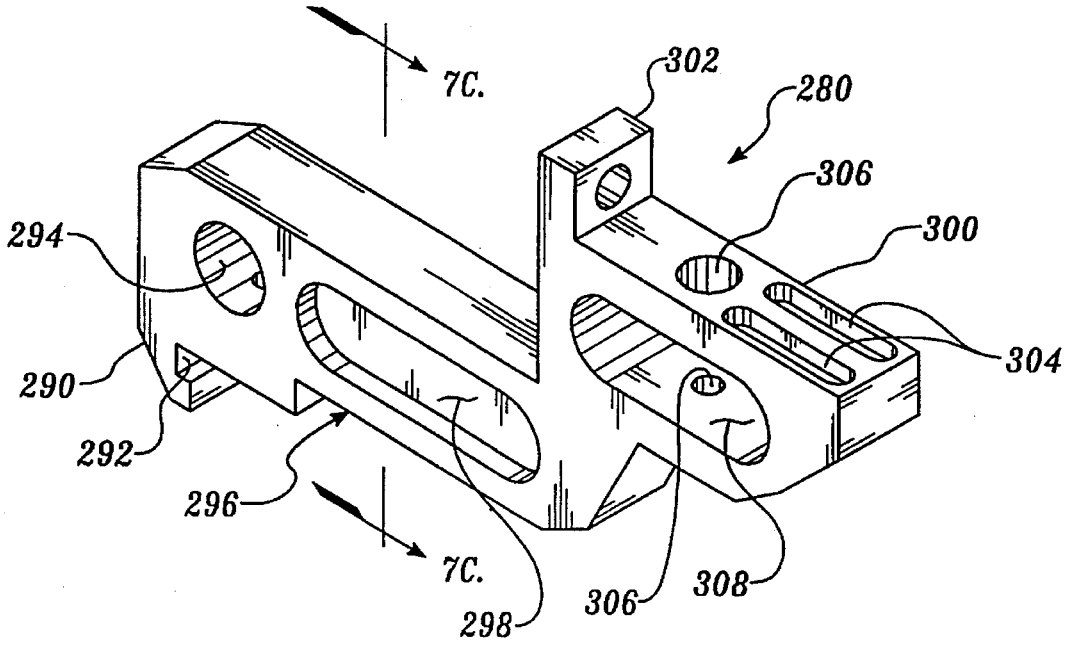
FIG. 7B is an isometric of a finger of the musical instrument bridge shown in FIG. 7A.
Figure 7C:
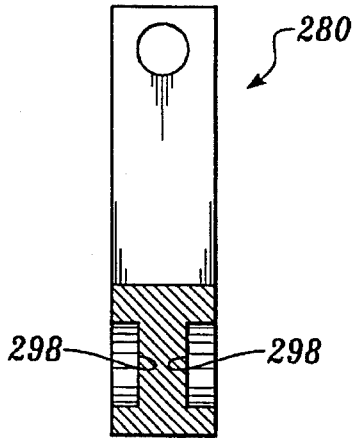
FIG. 7C is a vertical section along line 7C—7C of FIG. 7B.

FIGS. 7A–7C show an alternative embodiment of the musical instrument bridge shown in FIGS. 1–4. The musical instrument bridge 245 includes a plate 250, a mounting block 270, and a plurality of fingers 280. The plate includes a plurality of holes 252 disposed about its perimeter for mounting screws or other suitable fasteners (not shown) to secure the bridge 245 to a musical instrument. A series of holes 254 align with a corresponding series of holes 272 on the mounting block 270 to allow a machine screw or other suitable fastener to secure the mounting block 270 to the plate 250. Finally, the plate 250 includes a series of holes 256 that align with a series of holes 278 on the mounting block in order to secure the fingers 280 to the mounting block 270 and to the plate by machine screws or fasteners 258.

As with the previously described embodiments of the musical instrument bridge in accordance with the present invention, the mounting block 270 also includes a plurality of slots 276 in which the plurality of fingers 280 are fitted. Each finger 280 further includes a saddle 282 that is secured to the finger with an adjustment screw 284. A compression spring 286 biases the saddle away from the corresponding saddle stop. The compression spring 286 is disposed over the adjustment screw and rests between the saddle stop and the saddle 282. The height of the saddle 282 is adjusted using a pair of adjustment screws 288 as previously described. The difference between the musical instrument bridge 245 as shown in FIG. 7A and the musical instrument bridge 50 shown in FIGS. 1–4 is the shape of the waist portion of the fingers.

FIG. 7B is an isometric view of a single finger 280. The finger includes a base portion 290, a waist portion 296, and a head portion 300. The base portion includes a groove 292 that snugly mates with a corresponding lip on the mounting block for a secure interconnection that assures that the finger will not rotate forward when the strings supported by the bridge are tightened. An area 294 is removed from the base portion of the finger to reduce the weight of the finger 280. As indicated above, the head portion 300 includes a saddle stop 302 and a pair of slots 304 to maintain the alignment of the saddle (not shown). Additionally, a hole 306 is disposed in the head portion through which the string supported by the finger is threaded.

The difference between the fingers 280 and the fingers 100, described above, is the shape of the waist portion 296. In the fingers 280, the waist portion extends substantially horizontally from the base portion to the head portion of the finger. The waist portion includes a pair of opposing slots 298 that are machined along the length of the waist portion. The dimensions of the slot, namely, its length and depth, aid in determining the resonant frequency of the finger. By varying the dimensions of the opposing slots 298, the resonant frequency of the finger can be adjusted for the particular guitar string supported by the finger. Different fingers in the bridge 245 have different slot lengths and hence different resonant frequencies.

FIG. 7C shows a cross-sectional view of the waist portion of the finger 280. As can be seen, the opposing slots 298 create an "I beam" in the waist portion. The I beam has a web that is vertically oriented so as to promote the lateral movement of the finger but oppose vertical movement. Therefore the finger 280 provides the increased sustain, reduced distortion and enhanced clarity of the sound produced by a string that is supported by the finger.

FIGS. 8A–8E show the currently preferred embodiment of the musical instrument bridge of the present invention for use with a six-string electric guitar and a six-string steel guitar. The bridge 325 comprises a plate 330, a block 340, and a plurality of fingers 370. As with the previously described embodiments of the musical instrument bridge, the plate 330 has a plurality of holes 332 disposed around its perimeter. A plurality of slots 334 are disposed in the plate to allow a string to be inserted into the bridge from behind the instrument body without removing the plate or other components of the bridge. Finally, the plate includes a plurality of holes 336 that are used to secure the block 340 and a plurality of fingers 370 to the plate using a number of bolts or other suitable fasteners 338.

In contrast to the other embodiments of the musical instrument bridges described above, the block 340 is comprised of three distinct parts. A riser block 342 includes a plurality of holes 344 that align with the holes 336 in the plate 330. Additionally, the riser block 342 includes a series of slots 346 that align with the slots 334. One or more shims 348 may be disposed between the riser block and a mounting block 352. The shims include a plurality of holes 350 that align with the holes 344. By adjusting the height of the riser block and the number of shims placed between the riser block and the mounting block, the musical instrument bridge 325 can be made to fit virtually any type of electric guitar.

The mounting block 352 has a plurality of slots 354 into which the plurality of fingers 370 are snugly fitted. The mounting block also includes a plurality of holes 356 that align with the holes 336 of the plate 330. The fingers 370 of the musical instrument bridge are cantilevered to the mounting block using a number of bolts or other suitable fasteners 338 that extend from behind the plate 330 through the riser block 342, any shims 348 and the mounting block 352.

Each finger 370 includes a saddle 372, which is secured to the mounting block using a longitudinal adjustment screw 374. A compression spring 376 is disposed over the longitudinal adjustment screw 374 to lie between the saddle stop and the saddle 372. A pair of vertical adjustment screws 378 are used to adjust the height of the saddle 372 above the finger 370.

In the presently preferred embodiment of the invention, the plate 330, the mounting block 352, and the fingers 370 are made of brass while the riser block 342 and shims 348 are made of aluminum. However, other types of metal may work equally as well, such as stainless steel, titanium, etc.

Figure 8A:
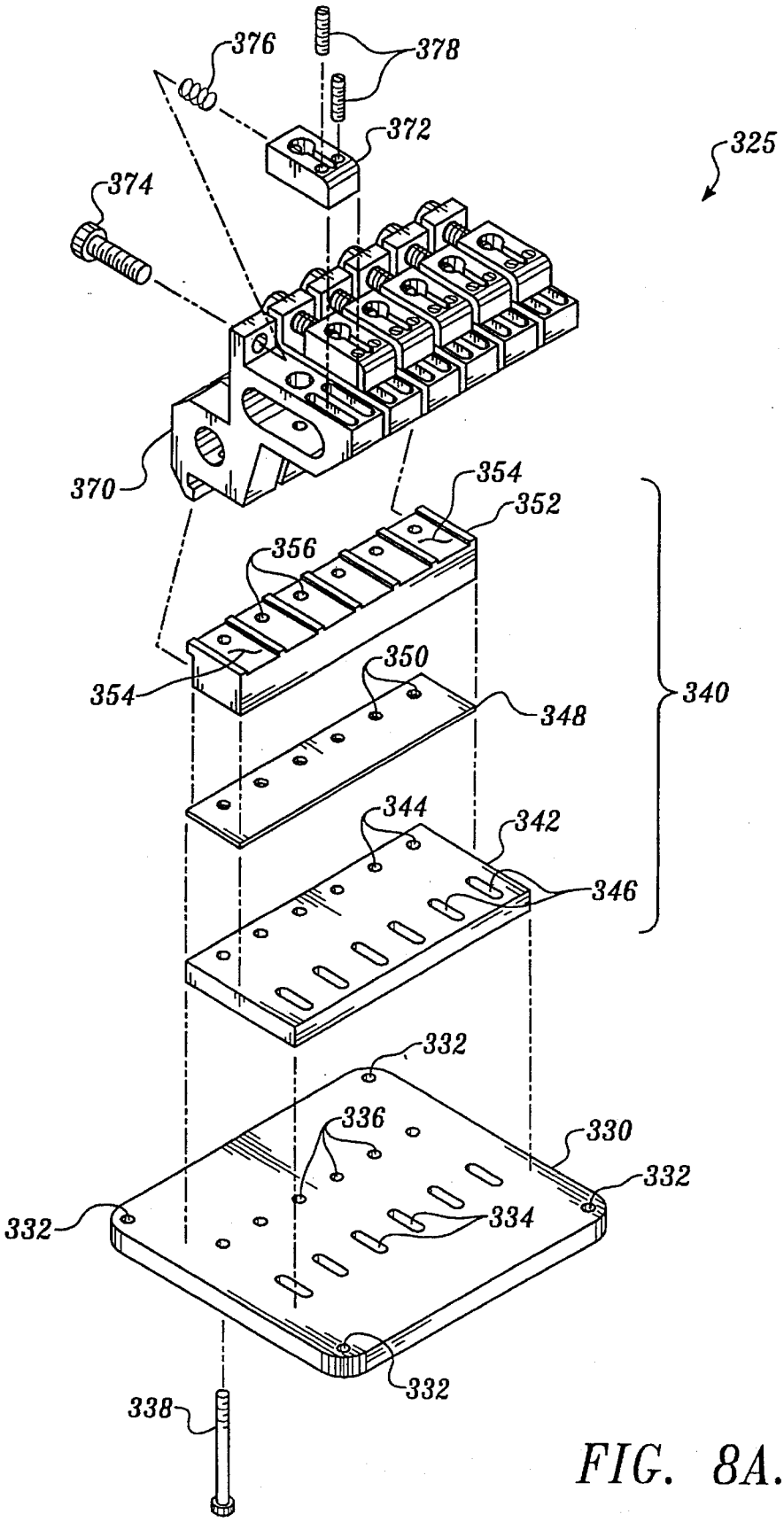
FIG. 8A is an isometric of another alternate embodiment of the musical instrument bridge for a six-string guitar according to the present invention, with parts shown in exploded relationship.
Figure 8B:
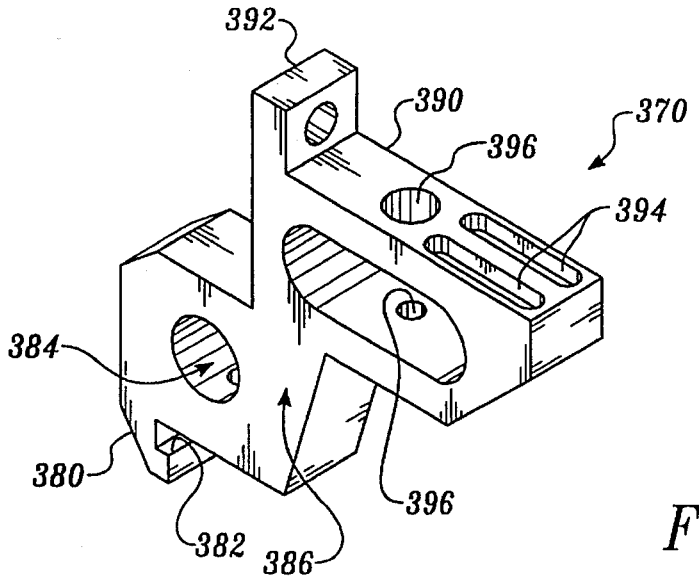
FIG. 8B is an isometric of a finger of the musical instrument bridge shown in FIG. 8A.

FIG. 8B is an isometric of a single finger 370 shown in FIG. 8A. Each finger 370 includes a base portion 380, a waist portion 386, and a head portion 390. The base portion includes a groove 382 that snugly mates with a corresponding lip on the mounting block 352 to prevent the finger from rotating forward when the string supported by the finger is tightened. Additionally, the base portion includes an area 384 that is drilled in the base portion to lighten the finger.

The head portion 378 of the finger includes a saddle stop 392, and a pair of grooves 394 to align the saddle (not shown). A hole 396 is disposed in the head portion to allow a string to be threaded through the head portion and over the saddle. The difference between the fingers 370 and the fingers 100 described above, is that the waist portion 386 has been shortened and is substantially the same width of the base portion and the head portion.

Figure 8C:
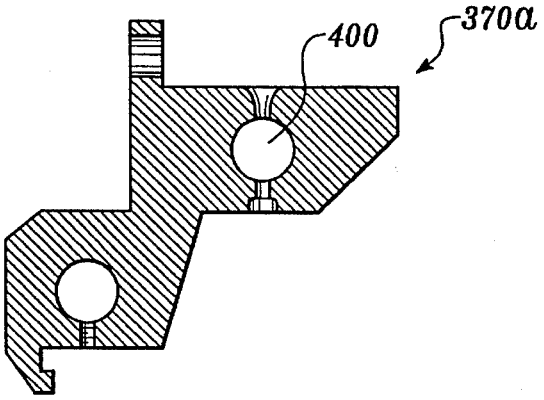
FIGS. 8C, 8D and 8E are corresponding side elevations of three embodiments of the finger shown in FIG. 8B, with pans shown in section.
Figure 8D:
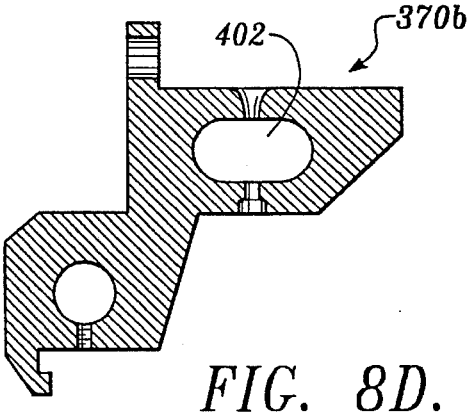

FIGS. 8C–8D show cross sections of three variations of the fingers 370 for use with different strings of a conventionally tuned six-string electric guitar. Each finger has the same profile but varies in mass according to the frequency of the string to be supported by the finger. FIG. 8C shows a finger 370*a* for use with a low E, and A strings of an electric guitar. The finger 370*a* has a circular area 400 drilled symmetrically about the hole 396. The circular area 400 reduces the mass of the head portion of the finger and adjusts the resonant frequency of the finger.

FIG. 8D shows a finger 370*b* for use with the D and G strings of a six-string electric guitar. The finger 370*b* has an elliptical area 402 removed from the head portion. The elliptical area 402 is somewhat larger than the circular area 400 removed from the head portion of the finger 370*a*. The mass of the finger 370*b* is lighter than the mass of the finger 370*a*, thereby giving the finger 370*b* a higher resonant frequency than the finger 370*a*.

Figure 8E:
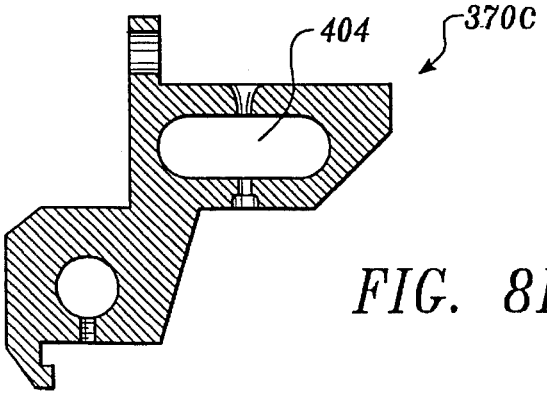

FIG. 8E shows a finger 370*c* for use with a high B and E strings of electric guitar. The finger 370*c* has a larger elliptical area 406 removed from the head portion. The elliptical area 406 is larger in length than the elliptical area 402 removed from the finger 370*b*. The mass of the finger 370*c* is lighter than the mass of the fingers 370*a* and 370*b*, thereby giving the finger 370*c* a higher resonant frequency.

By changing the dimensions of the area removed in the head portion, the resonant frequency of the finger is changed. The more mass removed from the head portion, the higher the resonant frequency of the finger. By adjusting the mass of the finger 370, the fingers can be constructed to produce the best tone and sustain for a string of any tuning.

As indicated above, the musical instrument bridge of the present invention has also been used in a steel guitar. In particular, the bridge shown in FIGS. 8A–8E has been adapted for use in a lap-type electric steel guitar. By slightly increasing the size of the plate and the width of the mounting block to accommodate the wider string spacing on the steel guitar, the bridge has been shown to provide increased sustain, string isolation, tonal clarity and elimination of conflicting frequencies. The fingers used for the steel guitar are the same as those for a conventional electric six-string guitar even though the tuning of the steel guitar differs from that of the standard guitar.

The present invention has several advantages over prior art instrument bridges. The first advantage provided by the present invention is the increased harmonic content of a note played. It is believed that vibrations from the string are transferred through the fingers to the plate and into the body of the instrument. These vibrations then interact with the body of the instrument and are returned to the vibrating string via the finger to create a richer, more complex sound. The tone quality of the sound produced by a string is affected by the resonant frequency of each finger on the bridge. The resonant frequency of a finger is adjusted by selecting the material from which the plate, mounting block and fingers are made, as well as by adjusting the mass of the finger itself.

As indicated above, it has been determined that the most suitable material from which to make the bridge according to the present invention is brass. The mass of the fingers is adjusted by removing material from the head portion and/or the base portion. As was also previously indicated, the optimum resonant frequency for each of the fingers is somewhat a matter of taste. However, it has been determined that if the resonant frequency of the finger is the same as the pitch of the string, the finger will dampen the motion of the string as it is played, thereby producing little or no sound. Thus, the fingers should not have a resonant frequency that is exactly the same as the pitch of the string.

The second advantage of the musical instrument bridge according to the present invention is a reduction in interstring modulation, whereby striking one string of the instrument causes vibration of another string of the instrument. Because all the fingers are spaced apart to be independent of each other except for their common connection to the mounting block, the vibration of one string on the instrument causes little vibration in the other strings of the instrument. Therefore, the resulting sound produced by the instrument is cleaner with little sympathetic interstring vibration.

The third advantage provided by the present invention is a reduction in the orbital motion of the string as it is struck. The construction of the fingers allows them to vibrate laterally in a plane that is substantially parallel with the plane of the plate and consequently the front face of the instrument. However, the construction of the fingers reduces motion of the string in a plane perpendicular to the plane of the plate. This lateral motion of the string produces the strongest signal in a magnetic pickup and minimizes signal distortion. Thus, the bridge according to the present invention produces cleaner and stronger output signals than are obtained with prior art instrument bridges.

While the preferred embodiment of the invention has been illustrated and described, it will be appreciated that various changes can be made therein without departing from the spirit and scope of the invention. For example, the fingers shown in the first and second embodiments have an "S" shape whereby the base portion of the finger sits lower than the head portion when the bridge is mounted in the instrument. Additionally, the fingers could be made having an "L" shape and secured to the plate directly without a mounting block or an 'T' shape where the head portion is disposed directly above the base portion. Furthermore, in some instruments it may be desirable to mount the fingers directly to the body of the instrument using a machine screw or the like without using a plate. Finally, although the present invention has been described with respect to electric instruments, the bridge will work with acoustic instruments as well.

The embodiments of the invention in which an exclusive property or privilege is claimed are defined as follows:

1. A musical instrument bridge for supporting a set of strings above a front face of a musical instrument, wherein each string of the set of strings is tuned to a predetermined pitch when the musical instrument is played, the musical instrument bridge comprising:

a plate that is attachable to the musical instrument;

several fingers cantilevered from the plate, each of said fingers having a resonant frequency and being configured to support a string of the set of strings above the front face of the musical instrument, said fingers being arranged in a row such that a first finger of said several fingers is disposed at one end of the row, a second finger of said set fingers is disposed at an opposite end of the row and all other of said several fingers are disposed intermediate said first and second fingers with no additional fingers located outward of said first and second fingers, the resonant frequency of said first finger being different than the resonant frequency of said second finger.

2. The musical instrument bridge of claim 1, wherein each of the first and second fingers has a base portion that is secured to the plate, a head portion that is configured to anchor an end of the string supported by the finger and a waist portion that extends between the base portion and the head portion, the waist portion of each of said first and second fingers having a width dimension, the width dimension of the waist portion of the first finger being different than a width dimension of the waist portion of the second finger.

3. The musical instrument bridge of claim 1, wherein each of the first and second fingers has a base portion that is secured to the plate, a head portion that is configured to anchor an end of the string supported by the finger and a waist portion that extends between the base portion and the head portion, the head portion of each of the first and second fingers having a hold therein, the hole of the head portion of the first finger being a different size than the size of a hole of the head portion of the second finger.

4. The musical instrument bridge of claim 1, wherein each of the first and second fingers has a base portion that is secured to the plate, a head portion that is configured to anchor an end of the string supported by the finger and a waist portion that extends between the base portion and the head portion, the waist portion of each of the first and second fingers having a pair of opposing slots that extend lengthwise along a length of the waist portion, the opposing slots of the first finger having a dimension that is different than a dimension of the opposing slots of the second finger.

5. The musical instrument bridge of claim 1, wherein each of the first and second fingers has a base portion that is secured to the plate, a head portion that is configured to anchor an end of the string supported by the finger and a waist portion that extends between the base portion and the head portion, each of the first and second fingers having a mass, the mass of the first finger being different than the mass of the second finger.

6. The musical instrument bridge of claim 1, wherein each of the first and second fingers has a base portion that is secured to the plate, a head portion that is configured to anchor an end of the string supported by the finger and a waist portion that extends between the base portion and the head portion, each of the first and second fingers having a groove that extends between the base portion of such finger and the waist portion of such finger, the groove of the first finger having a length that is different than a length of the groove of the second finger.

7. The musical instrument bridge of claim 1, further comprising a mounting block disposed between the plate and the fingers.

8. The musical instrument bridge of claim 7, wherein the mounting block and the base portion of each of said fingers have respective interfitting portions including a groove and an outwardly extending lip received in the groove.

9. The musical instrument bridge of claim 7, wherein the mounting block includes a plurality of slots into which each of said fingers is secured.

10. The musical instrument bridge of claim 9, wherein each of the fingers is secured to the mounting block independently of any other of the fingers.

11. A musical instrument bridge for supporting a set of strings above a front face of a musical instrument, wherein each string of the set of strings is tuned to a predetermined pitch when the musical instrument is played, the musical instrument bridge comprising:

a plate that is attachable to the musical instrument;

several fingers cantilevered from the plate, each of said fingers having a resonant frequency and being configured to support a string of the set of strings above the front face of the musical instrument, said fingers being arranged in a row such that two of said fingers define a first end finger and a second end finger disposed, respectively, at opposite ends of the row and a first mid finger and a second mid finger disposed intermediate said first and second end fingers, the resonant frequency of said first mid finger being different than the resonant frequency of said second mid finger.

12. The musical instrument bridge of claim 11, wherein each of the first and second mid fingers has a base portion that is secured to the plate, a head portion that is configured to anchor an end of the string supported by the finger and a waist portion that extends between the base portion and the head portion, the waist portion of each of the first and second mid fingers having a width dimension, the width dimension of the waist portion of the first finger being different than the width dimension of the waist portion of the second mid finger.

13. The musical instrument bridge of claim 11, wherein each of the first and second mid fingers has a base portion that is secured to the plate, a head portion that is configured to anchor an end of the string supported by the finger and a waist portion that extends between the base portion and the head portion, the head portion of each of the first and second mid fingers having a hole therein, the hole of the head portion of the first mid finger being a different size than a size of the hole of the head portion of the second mid finger.

14. The musical instrument bridge of claim 11, wherein each of the first and second mid fingers has a base portion that is secured to the plate, a head portion that is configured to anchor an end of the string supported by the finger and a waist portion that extends between the base portion and the head portion, the waist portion of each of the first and second mid fingers having a pair of opposing slots that extend lengthwise along a length of the waist portion, the opposing slots of the first mid finger having a dimension that is different than a dimension of the opposing slots of the second mid finger.

15. The musical instrument bridge of claim 11, wherein each of the first and second mid fingers has a base portion that is secured to the plate, a head portion that is configured to anchor an end of the string supported by the finger and a waist portion that extends between the base portion and the head portion, each of the first and second mid fingers having a mass, the mass of the first mid finger being different than the mass of the second mid finger.

16. The musical instrument bridge of claim 11, wherein each of the first and second mid fingers has a base portion that is secured to the plate, a head portion that is configured to anchor an end of the string supported by the finger and a waist portion that extends between the base portion and the head portion, each of the first and second mid fingers having a groove that extends between the base portion of such finger and the waist portion of such finger, the groove of the first mid finger having a length that is different than a length of the groove of the second mid finger.

17. The musical instrument bridge of claim 11, further comprising a mounting block disposed between the plate and the fingers.

18. The musical instrument bridge of claim 17, wherein the mounting block and the base portion of each of said fingers have respective interfitting portions including a groove and an outwardly extending lip received in the groove.

19. The musical instrument bridge of claim 17, wherein the mounting block includes a plurality of slots into which each of said fingers is secured.

20. The musical instrument bridge of claim 19, wherein each of the fingers is secured to the mounting block independently of any other of the fingers.

21. A musical instrument bridge for supporting a set of strings above a front face of a musical instrument, wherein each string of the set of strings is tuned to a predetermined pitch when the musical instrument is played, the musical instrument bridge comprising:

a plate that is attachable to the musical instrument;

several fingers cantilevered from the plate in a row, each of said fingers being configured to support a string of the set of strings above the front face of the musical instrument, wherein each of said fingers includes:

a base portion that is secured to the plate;

a head portion that is configured to anchor an end of the string supported by the finger; and a waist portion that extends between the base portion and the head portion, the waist portion of each of said fingers having a width dimension, wherein the waist portion of a first finger of said several fingers has a width dimension that is different than the width dimension of the waist portion of a second finger of said several fingers.

22. The musical instrument bridge of claim 21, wherein each of the first and second fingers has a resonant frequency, the resonant frequency of the first finger being different than the resonant frequency of the second finger.

23. The musical instrument bridge of claim 21, further comprising a mounting block disposed between the plate and the fingers.

24. The musical instrument bridge of claim 23, wherein the mounting block and the base portion of each of the fingers have respective interfitting portions including a groove and an outwardly extending lip received in the groove.

25. The musical instrument bridge of claim 23, wherein the mounting block includes a plurality of slots into which each of the fingers is secured.

26. The musical instrument bridge of claim 23, wherein each of the fingers is secured to the mounting block independently of any other of the fingers.

27. A musical instrument bridge for supporting a set of strings above a front face of a musical instrument, wherein each string of the set of strings is tuned to a predetermined pitch when the musical instrument is played, the musical instrument bridge comprising:

a plate that is attachable to the musical instrument;

several fingers cantilevered from the plate in a row, each of the fingers being configured to support a string of the set of strings above the front face of the musical instrument, wherein each of the fingers includes:

a base portion that is secured to the plate;

a head portion that is configured to anchor an end of the string supported by the finger; and a waist portion that extends between the base portion and the head portion, the head portion of each of the fingers having a hole therein, wherein the hole of the head portion of a first finger of the several fingers is a different size than a size of the hole of the head portion of a second finger of the several fingers.

28. The musical instrument bridge of claim 27, wherein each of the first and second fingers has a resonant frequency, the resonant frequency of the first finger being different than the resonant frequency of the second finger.

29. The musical instrument bridge of claim 27, further comprising a mounting block disposed between the plate and the fingers.

30. The musical instrument bridge of claim 29, wherein the mounting block and the base portion of each of the fingers have respective interfitting portions including a groove and an outwardly extending lip received in the groove.

31. The musical instrument bridge of claim 29, wherein the mounting block includes a plurality of slots into which each of the fingers is secured.

32. The musical instrument bridge of claim 29, wherein each of the fingers is secured to the mounting block independently of any other of the fingers.

33. A musical instrument bridge for supporting a set of strings above a front face of a musical instrument, wherein each string of the set of strings is tuned to a predetermined pitch when the musical instrument is played, the musical instrument bridge comprising:

a plate that is attachable to the musical instrument;

several fingers cantilevered from the plate in a row, each of the fingers being configured to support a string of the set of strings above the front face of the musical instrument, wherein each of the fingers includes:

a base portion that is secured to the plate;

a head portion that is configured to anchor an end of the string supported by the finger; and a waist portion that extends between the base portion and the head portion, the waist portion of each of the fingers having a pair of opposing slots that extend lengthwise along a length of the waist portion, the opposing slots of a first finger of the several fingers having a dimension that is different than a dimension of the opposing slots of a second finger of the several fingers.

34. The musical instrument bridge of claim 33, wherein each of the first and second fingers has a resonant frequency, the resonant frequency of the first finger being different than the resonant frequency of the second finger.

35. The musical instrument bridge of claim 33, further comprising a mounting block disposed between the plate and the fingers.

36. The musical instrument bridge of claim 35, wherein the mounting block and the base portion of each of the fingers have respective interfitting portions including a groove and an outwardly extending lip received in the groove.

37. The musical instrument bridge of claim 35, wherein the mounting block includes a plurality of slots into which each of the fingers is secured.

38. The musical instrument bridge of claim 35, wherein each of the fingers is secured to the mounting block independently of any other of the fingers.

39. A musical instrument bridge for supporting a set of strings above a front face of a musical instrument, wherein each string of the set of strings is tuned to a predetermined pitch when the musical instrument is played, the musical instrument bridge comprising:

a plate that is attachable to the musical instrument;

several fingers cantilevered from the plate in a row, each of the fingers being configured to support a string of the set of strings above the front face of the musical instrument, wherein each of the fingers includes:

a base portion that is secured to the plate;

a head portion that is configured to anchor an end of the string supported by the finger; and a waist portion that extends between the base portion and the head portion, each of the fingers having a mass, the mass of a first finger of the several fingers being different than the mass of a second finger of the several fingers.

40. The musical instrument bridge of claim 39, wherein each of the first and second fingers has a resonant frequency, the resonant frequency of the first finger being different than the resonant frequency of the second finger.

41. The musical instrument bridge of claim 39, further comprising a mounting block disposed between the plate and the fingers.

42. The musical instrument bridge of claim 41, wherein the mounting block and the base portion of each of the fingers have respective interfitting portions including a groove and an outwardly extending lip received in the groove.

43. The musical instrument bridge of claim 41, wherein the mounting block includes a plurality of slots into which each of the fingers is secured.

44. The musical instrument bridge of claim 41, wherein each of the fingers is secured to the mounting block independently of any other of the fingers.

45. A musical instrument bridge for supporting a set of strings above a front face of a musical instrument, wherein each string of the set of strings is tuned to a predetermined pitch when the musical instrument is played, the musical instrument bridge comprising:

a plate that is attachable to the musical instrument;

several fingers cantilevered from the plate in a row, each of the fingers being configured to support a string of the set of strings above the from face of the musical instrument, wherein each of the fingers includes:

a base portion that is secured to the plate;

a head portion that is configured to anchor an end of the string supported by the finger; and a waist portion that extends between the base portion and the head portion, each of the fingers having a groove that extends between the base portion of the finger and the waist portion of the finger, wherein the groove of a first finger of the several fingers has a length that is different than a length of the groove of a second finger of the several fingers.

46. The musical instrument bridge of claim 45, wherein each of the first and second fingers has a resonant frequency, the resonant frequency of the first finger being different than the resonant frequency of the second finger.

47. The musical instrument bridge of claim 45, further comprising a mounting block disposed between the plate and the fingers.

48. The musical instrument bridge of claim 47, wherein the mounting block and the base portion of each of the fingers have respective interfitting portions including a groove and an outwardly extending lip received in the groove.

49. The musical instrument bridge of claim 47, wherein the mounting block includes a plurality of slots into which each of the fingers is secured.

50. The musical instrument bridge of claim 47, wherein each of the fingers is secured to the mounting block independently of any other of the fingers.

* * * * *